United States Patent [19]

Orbanic

[11] Patent Number: 4,718,853

[45] Date of Patent: Jan. 12, 1988

[54] FOUR POLE, VEHICLE-TRAILER ELECTRICAL CONNECTOR

[75] Inventor: Robert S. Orbanic, Warren, Pa.

[73] Assignee: GTE Products Corporation, Stamford, Conn.

[21] Appl. No.: 914,042

[22] Filed: Oct. 1, 1986

[51] Int. Cl.[4] ..... H01R 13/70

[52] U.S. Cl. ..... 439/35; 200/51.04; 200/292; 280/422

[58] Field of Search ..... 339/10, 17 R, 17 C, 339/18 R, 18 C, 18 B, 18 P, 28, 29 R; 200/5 R, 5 A, 11 R, 11 DA, 51.02–51.07, 292; 280/422; 439/35, 43, 49–53

[56] References Cited

U.S. PATENT DOCUMENTS

| | | | |
|---|---|---|---|
| 2,660,679 | 11/1953 | Hunt | 280/422 |
| 2,794,081 | 5/1957 | Luhn | 200/292 |
| 4,057,310 | 11/1977 | Young | 339/10 |
| 4,158,114 | 6/1979 | Butler et al. | 200/5 R |
| 4,460,811 | 7/1984 | Murr et al. | 200/51.03 |
| 4,579,407 | 4/1986 | Shimada | 339/29 R |

*Primary Examiner*—Neil Abrams

*Attorney, Agent, or Firm*—William H. McNeill

[57] ABSTRACT

An electrical connector for selectively connecting various electrical circuits of a first vehicle to corresponding electrical circuits of a second vehicle. The connector includes variably positionable switches whereby no rewiring of either vehicle is necessary. The housing for the connector is parallelepipedonal in form and the switches project from a major surface of the housing.

13 Claims, 7 Drawing Figures

FOUR POLE, VEHICLE-TRAILER ELECTRICAL CONNECTOR

FIELD OF THE INVENTION

The present invention relates to an electrical connector which is useful in quickly connecting a plurality of electrical circuits of a first vehicle to a corresponding plurality of electrical circuits of a second vehicle.

DESCRIPTION OF PRIOR ART

The need for electrically connecting one or more circuits of a first vehicle to a corresponding one or more circuits of a second vehicle is well known. For example, when a trailer is hitched to an automobile it is desirable to connect various automobile lighting circuits to corresponding trailer lighting circuits. In particular, it is desirable to connect the automobile tail light circuit, brake light circuit, turn signal circuit and hazard circuit to corresponding trailer light circuits. Heretofore, difficulty has been incurred in properly matching the wires of each respective circuit. In some applications it may actually be necessary to rewire in order to bridge corresponding circuits from an automobile or other first vehicle to a trailer or other second vehicle. Such rewiring may involve the stripping of existing wires and the patching together in a generally open environment using electrical tape. Such a connection is undesirable particularly in view of the possibility that such exposed connection may be separated by objects being placed in the trunk of the automobile or by any other undesirable contact with the connection.

It is highly desirable to provide a compact sealed electrical connector for connecting electrical circuits of a first vehicle to corresponding electrical circuits of a second vehicle.

It is further desirable to provide such an electrical connector which can bridge electrical circuits of a first vehicle with electrical circuits of a second vehicle without the need for rewiring or stripping of existing wires.

It is also desirable to provide such an electrical connector by means of which there is no undue delay in matching the wires of electrical circuits of a first vehicle with the wires of electrical circuits of a second vehicle.

It is further desirable to provide such an electrical connector by means of which there is no need to identify which wire is which in the electrical circuit of the first vehicle or in the electrical circuit of the second vehicle.

SUMMARY OF THE INVENTION

This invention achieves these and other results by providing an electrical connector comprising a housing having a plurality of first connectors coupled thereto. Each of the first connectors of the plurality of first connectors is electrically connectable to a separate first vehicle electrical circuit of a plurality of first vehicle electrical circuit. A plurality of second connectors is also coupled to the housing. Each of the second connectors of the plurality of second connectors is electrically connectable to a separate second vehicle electrical circuit of a plurality of second vehicle electrical circuits. Means is provided coupled to the housing for selectively electrically connecting each of the second connectors of the plurality of second connectors to a corresponding first connector of the plurality of first connectors. Preferably, such selectively electrically connecting means includes a plurality of selectable switching devices each of which can selectively electrically connect one of the second connectors of the plurality of second connectors to any of the first connectors.

DESCRIPTION OF THE PREFERRED EMBODIMENT

Figure 1:
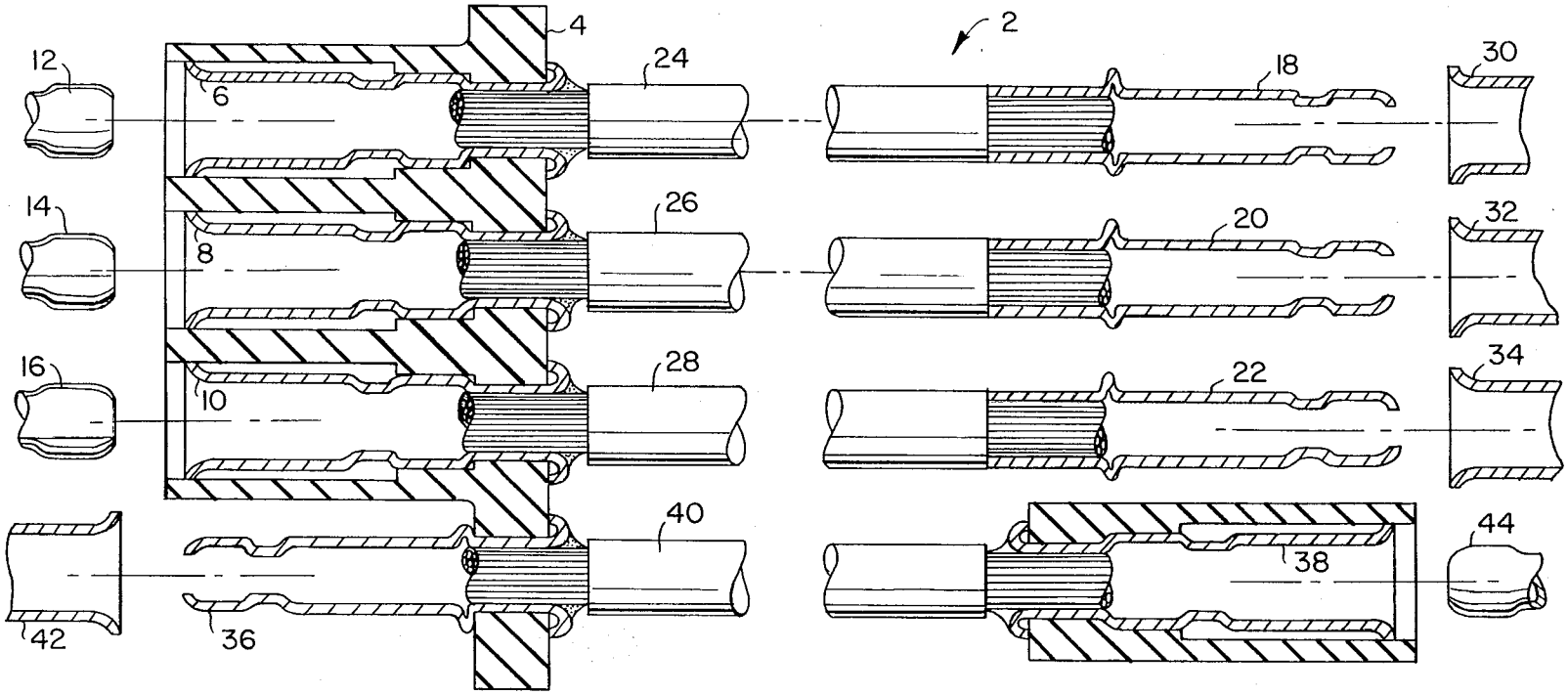
FIG. 1 is a plan view partially in cross section of one embodiment of the present invention.
Figure 7:
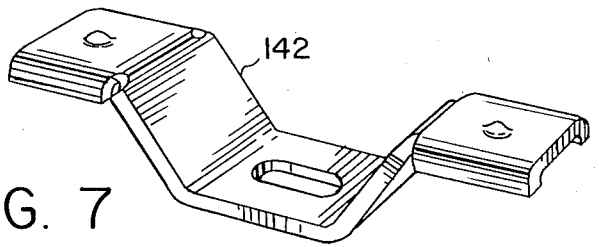

The embodiment of this invention which is illustrated in FIG. 1 is particularly suited for achieving the objects of this invention. FIG. 1 depicts an electrical connector 2 comprising a housing 4 having a plurality of first connectors 6, 8 and 10 coupled thereto. Each of the first connectors 6, 8 and 10 of the plurality of first connectors is electrically connectable to a separate first vehicle electrical circuit of a plurality of first vehicle electrical circuits. By way of example, first connectors 6, 8 and 10 are shown as female connectors or pins 12, 14 and 16 of a first standard four pole flat shrouded connector (not shown). A plurality of second connectors 18, 20 and 22 is also provided. Each of the second connectors 18, 20 and 22 of the plurality of second connectors is electrically connectable to a separate second vehicle electrical circuit of a plurality of second vehicle electrical circuits.

Means are provided coupled to housing 4 for selectively electrically connecting each one of the first vehicle electrical circuits to a corresponding second vehicle elecrical circuit. For example, FIG. 1 depicts a plurality of conductors each of which connects one of the first connectors 6, 8 and 10 to a corresponding second connector 18, 20 and 22. In particular, conductors 24, 26 and 28 respectively electrically connect af irst connector 6, 8 and 10 to a corresponding second connector 18, 20 and 22 and also couple each second connector 18, 20 and 22 to the housing 4 through first connectors 6, 8 and 10. In addition, each second connector 18, 20 and 22 is selectively connectable to any one of the second vehicle electrical circuits. For example, second connectors 18, 20 and 22 are shown as male connectors or pins capable of being electrically connected to separate second vehicle electrical circuits including female connectors or pins 30, 32 and 34 of a second standard four pole flat shrouded connector (not shown). In each four pole connector, one of the pins forms part of a right turn signal circuit, and one of the pins forms part of a brake/-running light circuit. it is apparent from FIG. 1 that each second connector 18, 20 and 33 can be alternately connected to any one of the second vehicle electrical circuits through female connectors 30, 32 and 34 until such time as the pins coupled to the first vehicle left turn signal circuit, right turn signal circuit, and brake/-running lights circuits are electrically coupled to respective of the pins which are coupled to the second vehicle left turn signal circuit, right turn signal circuit, and brake/running lights circuit.

To operate the embodiment of FIG. 1, the user connects pins 12, 14, 15, 42 and 44 to pins 6, 8, 10, 36 and 38 respectively. Then the user connects pin 18 to pin 30 and turns on the left turn signal of the first vehicle. If the left turn signal of the second vehicle does not go on the user connects pin 18 to pin 32, and then to pin 34 if necessary, until the second vehicle left turn signal is activated. In any event, when the left turn signal of the second vehicle is activated, the user leaves pin 18 connected to the activating pin of pins 30, 32 and 34, turns off the left hand signal in the first vehicle, turns on the right hand signal in the first vehicle and repeats the same operation with pin 20 by connecting pin 20 to the remaining two pins of pins 30, 32 and 34 until the right hand signal in the second vehicle is activated. When this occurs, pin 22 is then connected to the only remaining of pins 30, 32 and 34 which will be the brake/running lights circuit.

The electrical connector 2 of FIG. 1 also includes a first ground connector 36 which is attached to housing 4 and electrically connected to a second ground connector 38 by conductor 40 through which second ground connector 38 is also coupled to housing 4. The first ground connector 36 is connectable to a first vehicle ground by means of connector 42, and second ground connector 38 is connectable to a second vehicle ground by means of connector 44.

In the embodiment of FIGS. 2 to 7 an electrical connector 100 includes a housing 102 having a plurality of first connectors 104, 106 and 108 coupled thereto. Each of the first connectors 104, 106, 108 is electrically connectable to a separate first vehicle electrical circuit of a plurality of first vehicle electrical circuits.

A plurality of second connectors 110, 112 and 114 is also provided coupled to housing 102. Each of the second connectors 110, 112 and 114 of the plurality of second connectors is electrically connectable to a separate second vehicle elecrical circuit of a plurality of second vehicle electrical circuits.

Figure 4:
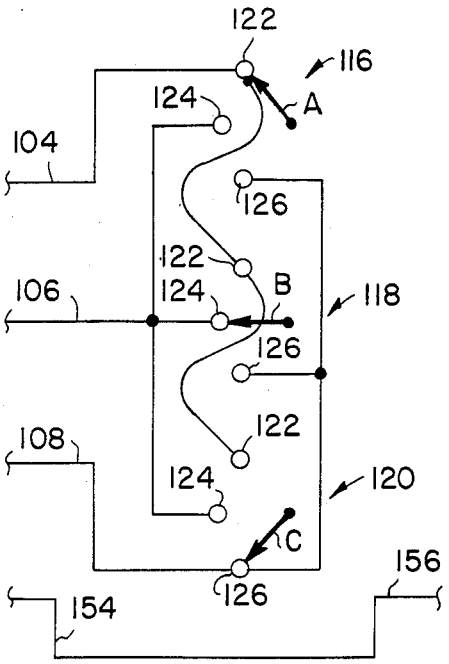
FIG. 4 is a schematic view of one feature of the present invention.

A plurality of selectable switching devices 116, 118 and 120 is provided. Each switching device 116, 118 and 120 is capable of selectively electrically connecting one of the second connectors 110, 112 and 114 to any of the first connectors 104, 106 and 108. To this end, and referring to FIG. 4, each selectable switching device 116, 118 and 120 includes a first vehicle first contact 122, a first vehicle second contact 124 and a first vehicle third contact 126. As depicted in FIG. 4, the first vehicle contacts 122 are electrically connected to each other and to a first connector 104, the first vehicle second contacts 124 are electrically connected to each other and to a first connector 106, and the first vehicle third contacts 126 are electrically connected to each other and to a first connector 108.

Figure 5:
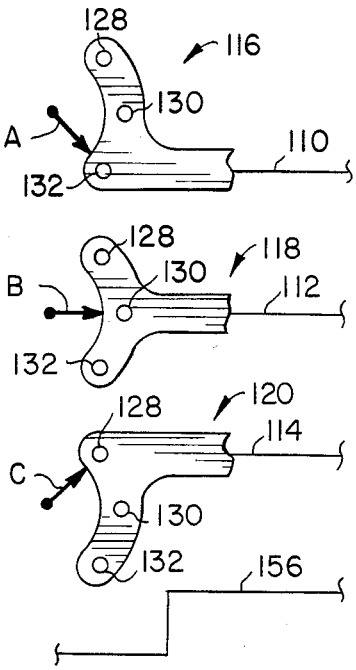
FIG. 5 is a schematic view of another feature of the present invention.

As depicted in FIG. 5, each selectable switching device 116, 118 and 120 also includes a second vehicle first contact 128, a second vehicle second contact 130, and a second vehicle third contact 132. As can be seen in FIG. 5, the second vehicle first contact 128, second contact 130 and third of selectable switching device 116 are electrically connected to each other and to a separate second connector 110. In a like manner, the second vehicle first contact 128, second contact 130 and third contact 132 of selectable switching device 118 are electrically connected to each other and to a separate second connector 112. Similarly, the second vehicle first contact 128, second contact 130 and third contact 132 of selectable switching device 120 are electrically connected to each other and to a separate second connector 114.

Each selectable switching device 116, 118 and 120 also includes a selector 140 (see FIGS. 2 & 3) coupled to the housing 102. Each selector 140 has a circuit contact 142 attached thereto as depicted in FIG. 3. Each selector 140 is rotatable about a respective axis 144 such that each selector is movable relative to housing 102 to selectively move the circuit contact 142 attached thereto to selectively close a circuit between the first vehicle contact 122, second contact 124 or third contact 126, and the second vehicle first contact 128, second contact 130, or third contact 132. In this manner the selector 140, and circuit contact attached thereto, of each switching device 116, 118 and 120 can be rotated to any of the circuit closing positions A, B, C depicted in FIG. 2.

Figure 6:
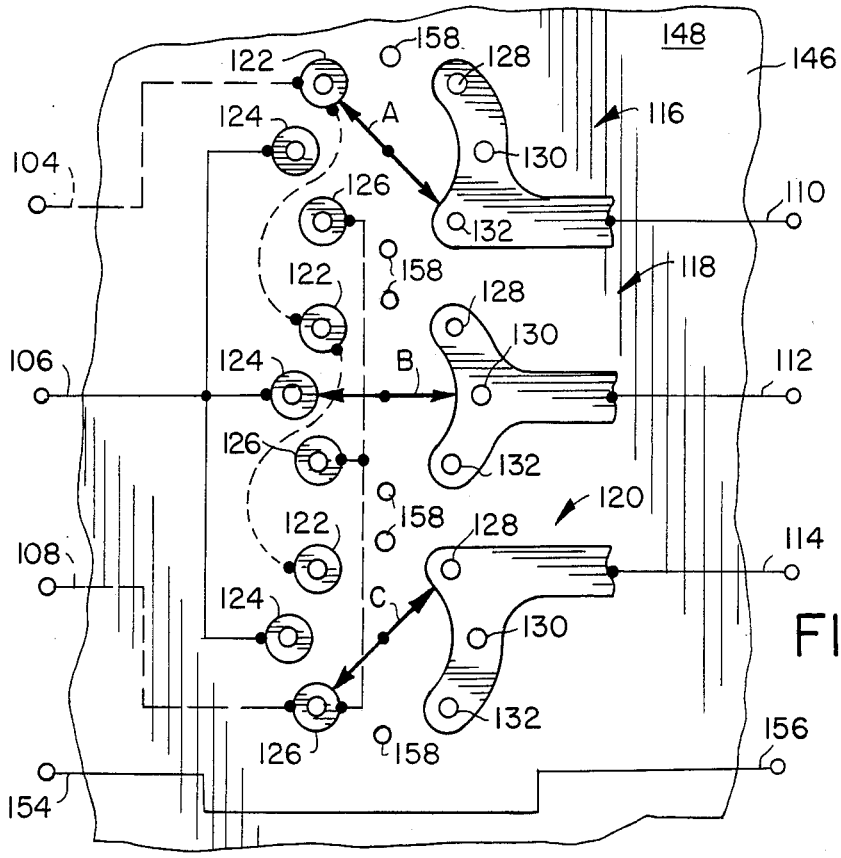
FIG. 6 is a sehcmatic view of the combined features of FIGS. 4 and 5; and, FIG. 7 is a perspective view of a circuit contact of the present invention.

In the preferred embodiment, the electrical connections between the various first vehicle first, second and third contacts, and the first connectors, and the electrical connections between the various second vehicle first, second and third contacts, and the second connectors, as described above, are effected by printed circuits of a printed circuit board 146 which is positioned within housing 102. For example, in the preferred embodiment, the circuit, depicted in FIG. 5 is positioned on the top of 148 of printed circuit board 146 as is one part of the circuit depicted in FIG. 4. Another part of the circuit of FIG. 4 is positioned on the bottom 150 of the printed circuit board 146. FIG. 6 diagrammatically depicts the relationship of such circuits relative to printed circuit board 146, the circuit of FIG. 5 and the part of the circuit of FIG. 4 positioned on the top 148 of the circuit board being shown in solid lines, and the part of the circuit of FIG. 4 positioned on the bottom 150 of the circuit board being shown in phantom lines. It will be noted that the part of the circuit of FIG. 4 positioned on the bottom 150 includes first vehicle first contacts 122 and third contacts 126 and that such contacts extend from the bottom surface 150 to the top surface 148 in a known manner by means of plated through portions 152. In this manner, the various circuits can be selectively closed, as described above, by virtue of the contact of a respective circuit contact 142 with a select first and second vehicle contact, in the case of first vehicle contacts 122 and 126 such contact being throughthe plate portions 152.

Figure 2:
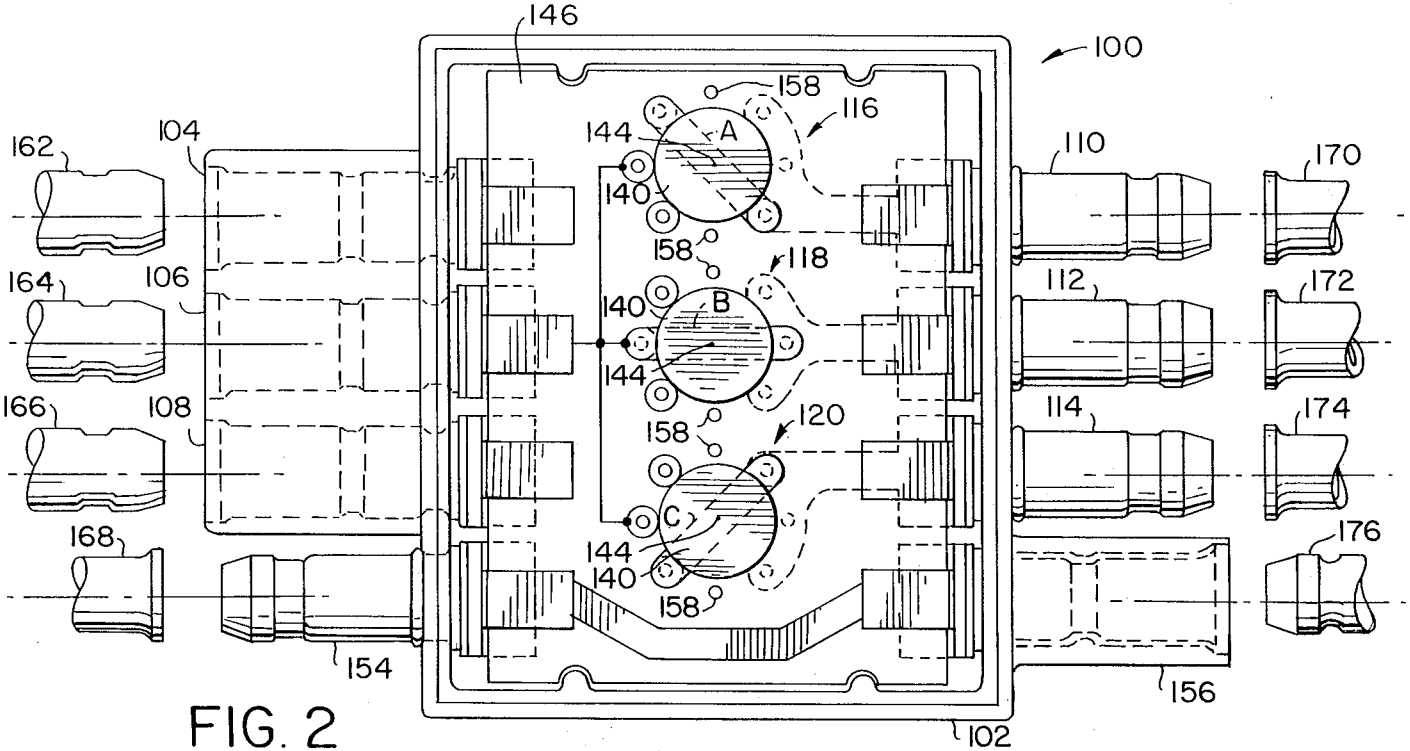
FIG. 2 is a plan view of another embodiment of the present invention with the cover 159 removed.
Figure 3:
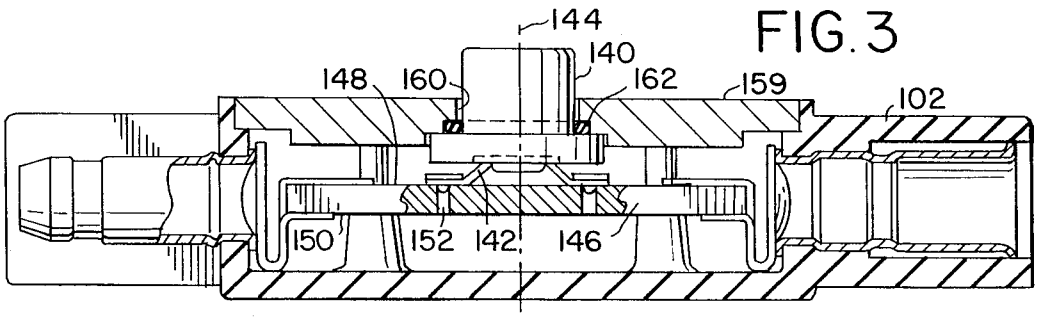
FIG. 3 is a view of the embodiment of the present invention of FIG. 2 taken along line 3—3.

In the embodiment of FIG. 2, each first connector 104, 106 and 108 is an oppositely mating pin relative to each second connector 110, 112 and 114. For example, connectors 104, 106 and 108 are female pins and connectors 110, 112 and 114 are male pins.

FIG. 2 depicts a first ground connector 154 attached to housing 102 and electrically connected to a second ground connector 156 which is also attached to housing 102. The first ground connector 154 is connectable to a first vehicle ground and the second ground connector 156 is connectable to a second vehicle ground. In the preferred embodiment the first ground connector 154 is an oppositely mating pin relative to the pins of first connectors 104, 106 and 108 and the second ground connector 156 is an oppositely mating pin relative to the pins of second connectors 110, 112 and 114.

In the preferred embodiment each of the selectors 140 is movable relative to housing 102 to selectively move a respective circuit contact 142 to open all circuits between the first vehicle contacts and the second vehicle contacts. In this manner the electrical connector 100 can be placed in a "neutral" or "off" condition. In the preferred embodiment, neutral contacts 158 are provided to this end.

In the embodiment of FIG. 3, the housing 102 includes a cover 159 having apertures 160 through each of which a selector 140 extends. Each selector is held in place and urged against an O-ring 162 by a circuit contact 142 having the configuration depicted in FIG. 7. In this manner a compact sealed electrical connector is provided, and such connector can bridge electrical circuits of a first vehicle with electrical circuits of a second vehicle without the need for rewiring or stripping of existing wires.

In the embodiment of FIG. 2 a plurality of first vehicle electrical circuits includes pins 162, 164, 166 and 168 and a plurality of second vehicle electrical circuits includes pins 170, 172, 174 and 176. For purposes of illustration it is assumed that of these pins only the ground pins are readily identifiable in that ground pin 168 is a female pin in a group of male pins and ground pin 176 is a male pin in a group of female pins. Although the other pins are not specifically identifiable by observation, each such pin is connected to a right hand turn signal circuit, left hand turn signal circuit, or brake/running light circuit. To operate, the user turns each selector 140 to contacts 158 which is the "off" position. The user then connects pins 162, 164, 166 and 168 to pins 104, 106, 108 and 154, and pins 170, 172, 174 and 176 to pins 110, 112, 114 and 156, respectively. Next the user turns one of the turn signals of the first vehicle on and then rotates the selector 140 of switching device 116 to each of the three dial positions 122, 132; 124, 130; 126, 128 in an attempt to also turn a similar second vehicle turn signal on. If such turn signal of the second vehicle does not go on, the user returns selector 140 of switching device 116 to the "off" position and goes on to selector 140 of switching device 118, and then to selector 140 of switching device 120 if necessary, and repeats the same operation until such turn signal of the second vehicle is activated. In any event, when such turn signal of the second vehicle is activated, the user leaves selector 140 of the switching device in its activation position, turns off the one turn signal in the first vehicle, turns the other turn signal on and repeats the same operation with selector 140 of each of the remaining switching devices until the other turn signal of the second vehicle is activated. When such other turn signal is activated, there will only be one remaining switching device in the "off" position, and the user repeats the same operation with such remaingng switching device to locate the proper position of selector 140 to activate the brake and running lights. In this manner there is no undue delay in matching the wires of electrical circuits of the first and second vehicles, and there is no need to identify which wire is which.

The embodiments which have been described herein are but some of several which utilize this invention and are set forth here by way of illustration but not of limitation. It is apparent that many other embodiments which will be readily apparent to those skilled in the art may be made without departing materially from the spirit and scope of the invention.

I claim:

1. An electrical connector for interconnecting first and second electrical circuits of two vehicles, said first circuit terminating in a four pole flat plug and said second circuit terminating in a four pole flat socket, said connector comprising:

a housing having a generally parallelepipedonal form with opposed major surfaces separated by and joined to minor surfaces, said major surfaces defining a given plane;

a plurality of first conenctors coupled to said housing and projecting from a first minor surface, each of said first connectors of said first plurality of first conenctors being electrically connectable to a separate first vehicle electrical circuit of a plurality of first vehicle electrical circuits via said four pole flat plug;

a plurality of second connectors coupled to said housing and projecting from a second minor surface, each of said second connectors of said plurality of second connectors being electrically connectable to a separate second vehicle electrical circuit of a plurality of second vehicle electrical circuits via said four pole flat socket; and means coupled to said housing for selectively electrically connecting each first vehicle electrical circuit to any one of the second vehicle electrical circuits, said means having selectors projecting from one of said major surfaces and each having an axis of rotation transverse to said given plane.

2. The electrical connector of claim 1 wherein said first vehicle electrical circuits include a first vehicle left turn signal electrical circuit, a first vehicle right turn signal electrical circuit, and a first vehicle brake/running lights electrical circuit, and wherein said second vehicle electrical circuits include a corresponding second vehicle left turn signal electrical circuit, second vehicle right turn signal electrical circuit, and second vehicle brake/running lights electrical circuit.

3. The electrical connector of claim 2 further including a first gound connector coupled to said housing and electrically connected to a second ground connector which is coupled to said housing, said first ground connector being connectable to a first vehicle ground and said second ground connector being connectable to a second vehicle ground.

4. The electrical connector of claim 1 wherein said selectively electrically connecting means includes a plurality of selectable switching devices each of which can selectively electrically connect one of said second connectors of said plurality of second connectors to any of said first connectors of said plurality of first connectors.

5. The electrical connector of claim 4 wherein each selectable switching device of said plurality of selectable switching devices includes a first vehicle first contact, a first vehicle second contact and a first vehicle third contact, said first vehicle first contacts all being electrically connected to each other and to one of said first connectors of said plurality of first connectors, said first vehicle second contacts all being electrically connected to each other and to another of said first connectors of said plurality of first connectors, and said first vehicle third contacts all being electrically connected to each other and to a further of said first connectors of said plurality of first connectors.

6. The electrical connector of claim 5 wherein each selectable switching device of said plurality of selectable switching devices further includes a second vehicle first contact, a second vehicle second contact and a second vehicle third contact, said second vehicle first, secnd and third contacts of each selectable switching device of said plurality of selectable switching devices being electrically connected to each other and to a separate of said second connectors of said plurality of second connectors.

7. The electrical connector of claim 6 wherein each respective selectable switching device of said plurality of selectable switching devices further includes a selector coupled to said housing, and a circuit contact attached to said selector, said selector being movable relative to said housing to selectively move said circuit contact to selectively close a circuit between said first vehicle first, second or third contact, and said second vehicle first, second or third contact, of said respective selectable switching device.

8. The electrical connector of claim 7 wherein said first vehicle first, second, and thrid contacts and said second vehicle first, second and third contacts are electrically connected, by printed circuits of a printed circuit board, said printed circuit board being contained within said housing.

9. The electrical connector of claim 8 wherein said first connectors of said plurality of first connectors, and said second connectors of said plurality of second connectors are electrically connected to respective of said printed circuits.

10. The electrical connector of claim 9 wherein each first connector of said plurality of first connectors is an oppositely mating pin relative to each second connector of said plurality of second connectors.

11. The electrical connector of claim 10 further including a first ground connector attached to said housing and electrically connected to a second ground connector which is attached to said housing, said first ground connector being connectable to a first vehicle ground and said second ground connector being connectable to a second vehicle ground.

12. The electrical connector of claim 11 wherein said first ground connector relative to each first connector said plurality of first connectors are oppositely mating pins and wherein said second ground connector relative to each second connector of said plurality of second connectors are oppositely mating pins.

13. The electrical connector of claim 12 wherein each of said selectors is movable relative to said housing to selectively move said circuit contact to open all circuits between said first vehicle contacts and said second vehicle contacts.

* * * * *